United States Patent [19]

Churchland

[11] Patent Number: 4,517,148

[45] Date of Patent: May 14, 1985

[54] METHOD FOR PRESSING A COMPOSITE ASSEMBLY

[75] Inventor: Mark T. Churchland, Vancouver, Canada

[73] Assignee: MacMillan Bloedel Limited, Vancouver, Canada

[21] Appl. No.: 547,574

[22] Filed: Nov. 1, 1983

[51] Int. Cl.[3] ..... D04H 1/16

[52] U.S. Cl. ..... 264/112; 100/154; 156/583.5; 264/119; 264/125; 264/324; 425/371

[58] Field of Search ..... 264/112, 113, 125, 324, 264/DIG. 75, 119; 425/371; 156/583.5; 100/153, 154

[56] References Cited

U.S. PATENT DOCUMENTS

| | | | |
|---|---|---|---|
| 3,071,805 | 1/1963 | Merkle | 264/324 |
| 3,120,862 | 2/1964 | Burger . | |
| 3,723,230 | 3/1973 | Troutner . | |
| 3,779,686 | 12/1973 | Kerttula et al. | 264/112 |
| 3,792,953 | 3/1974 | Ahrweiler . | |
| 3,795,470 | 3/1974 | De Mets | 264/113 |
| 3,851,685 | 12/1974 | Ahrweiler . | |
| 3,860,368 | 1/1975 | Kerttula et al. | 425/371 |
| 3,942,929 | 3/1976 | De Mets | 425/371 |
| 3,993,426 | 11/1976 | Ahrweiler . | |
| 4,043,732 | 8/1977 | Ahrweiler . | |
| 4,061,819 | 12/1977 | Barnes . | |
| 4,083,912 | 4/1978 | Platte et al. | 425/371 |
| 4,213,748 | 7/1980 | Ahrweiler . | |
| 4,311,550 | 1/1982 | Kerttula | 425/371 |
| 4,410,474 | 10/1983 | Ahrweiler | 425/371 |
| 4,417,865 | 11/1983 | Pfeiffer | 425/371 |
| 4,417,866 | 11/1983 | Sitzler | 425/371 |

FOREIGN PATENT DOCUMENTS

| | | | |
|---|---|---|---|
| 2205575 | 8/1973 | Fed. Rep. of Germany | 425/371 |
| 2557998 | 6/1977 | Fed. Rep. of Germany | 425/371 |
| 85838 | 12/1971 | German Democratic Rep. | 425/371 |

*Primary Examiner*—Jeffery Thurlow
*Assistant Examiner*—Patrick Dailey
*Attorney, Agent, or Firm*—Banner, Birch, McKie & Beckett

[57] ABSTRACT

The present invention relates to a process of forming an extended elongate product from a plurality of strands by subjecting the strands to heat and pressure. The improvement of the present invention comprises a method for compressing the strands in a manner to reduce internal stresses imparted to the product during its subjection to pressure. The method includes the steps of: (a) transporting in a longitudinal direction the strands in a generally parallel and overlapping relationship through a compressing zone of a press assembly; (b) increasing the pressure on the strands as they pass from an inlet end to an outlet end of the compressing zone by gradually converging facing walls of the press assembly so that: (i) the strands being compressed move relative to one another through at least a portion of the compressing zone; and (ii) the strands being compressed lock up so that they no longer move relative to one another but rather only compress relative to one another at a point in the compressing zone where the radius of curvature in the longitudinal direction on either side of a central reference plane of the mat being compressed is at least about 30 feet to provide a low remembered internal stress.

14 Claims, 5 Drawing Figures

COMPRESSION ZONE
LOCK-UP POINT
COMPRESSING ZONE
FLOW
A
10
12
14
16
18
20
22
24
26
7
$R_1$
$R_2$

METHOD FOR PRESSING A COMPOSITE ASSEMBLY

TECHNICAL FIELD

The present invention relates broadly to the field of belt presses and to a manufacturing technique for pressing composite assemblies with belt presses. The composite assemblies are made of a plurality of strands which are compressed into an end product. The present invention is particularly useful in the manufacture of elongated lumber products from wood strands.

BACKGROUND OF THE INVENTION

Numerous types of wood composite products have been manufactured by a process where assemblies of wood pieces, veneers, particles or the like are coated with an adhesive, and thereafter subjected to compression and heat to form the end product. For example, this technique is used to manufacture particle board from small wood particles and plywood from wood veneer sheets.

A process has recently been developed for manufacturing structural wood products from long, relatively thin strands of wood by coating the strands with an adhesive, arranging the strands side-by-side in a lengthwise dimension of the lumber product and subjecting the arranged strands to heat and compression. By this technique, a high strength dimensioned wood product can be formed. An example of such a process is disclosed in U.S. Pat. No. 4,061,819.

Belt presses, typically used in processes for the manufacture of composite wood products are shown, inter alia, in U.S. Pat. Nos. 3,120,862; 3,723,230; 3,792,953; 3,851,685; 3,993,426; 4,043,732 and 4,213,748. The belt presses are comprised, for example, of facing endless belts between which the material is compressed, and platens and antifriction devices which hold the belts in pressure engagement with the material. In these prior art compression techniques, the inlet end of the press belts, and the platens over which they run, converge toward one another to form a compressing zone.

It has been determined that within the compressing zone of a continuous press, strands are generally free to move with respect to one another for a short period of time. As the belts continue to converge, the strands are no longer free to move but, rather, have positions set with respect to one another. This setting of relative positions can be referred to as "lock-up." After lock-up occurs, further convergence of the press belts causes further compression of the material. Since lock-up occurs in a converging area, the material being pressed is not in a planar disposition, but rather in a curved disposition. This curved disposition occurs in two opposite directions about a reference plane passing between the belts. Since the material has locked up, the material cannot shift into a planar relationship, rather, the material is forced from this curved disposition into its final planar form. Following passage through the converging portion of the belts, i.e., the compressing zone, the compressed product generally passes through a compression zone in which the belts of the press are parallel.

It has been discovered that the curvature of the strands at lock-up remains or is remembered as an internal stress in the end product produced. When the end product is a generally thin planar object, such as plywood or particle board sheets, such internal stresses do not present a problem. However, when relatively thick products are manufactured, for example, dimensioned lumber made of wood strands, the internal stresses can present a problem because such thick products may be cut longitudinally, thereby releasing the internal stress. Thus, when the lumber product is cut horizontally, the two halves bow in opposite directions. The method of present invention has been developed to alleviate this internal stress problem.

A secondary internal stress problem, which occurs in a continuous process of forming dimensioned lumber products from thin wood strands, such as the product disclosed in U.S. Pat. No. 4,061,819, is a result of the manner in which the strands are arranged prior to their entry into the belt press. As wood strands are arranged aligned to one another in a longitudinal direction and successive layers of strands are laid upon one another, the strands do not rest level upon a preceeding strand, but rather a forward end of one strand rests upon a rearward end of a preceding strand. This results in a build-up of strands at an angle above the horizontal. This staggered, overlapping relationship can be referred to as "card-decking" because it is similar to the manner in which cards would lay upon one another when they are spread out on a flat surface from a stacked deck. This card-decking or angular build-up effect of the strands results in an internal stress in the dimensioned lumber product produced. Since the build-up occurs in one direction, the stress results in a bowing effect in one direction. Another aspect of the present invention is directed to alleviating this type of internal stress.

SUMMARY OF THE INVENTION

The present invention relates to a process of forming an extended elongate product from a plurality of strands by subjecting the strands to heat and pressure. The improvement of the present invention comprises a method for compressing the strands in a manner to reduce internal stresses imparted to the product during its subjection to pressure. The method includes the steps of: (a) transporting in a longitudinal direction the strands in a generally parallel and overlapping relationship through a compressing zone of a press assembly; (b) increasing the pressure on the strands as they pass from an inlet end to an outlet end of the compressing zone by gradually converging facing walls of the press assembly so that: (i) the strands being compressed move relative to one another through at least a portion of the compressing zone; and (ii) the strands being compressed lock up so that they no longer move relative to one another but rather only compress relative to one another at a point in the compressing zone where the radius of curvature in the longitudinal direction on either side of a central reference plane of the mat being compressed is at least about 30 feet to provide a low remembered internal stress.

In a preferred embodiment, the product being formed is an elongated lumber product made from a plurality of generally paralleled elongate wood strands, and the press assembly is comprised of a belt press having facing belts trained over platens. The pressure on the wood strands is increased by gradually converging the platens and belts.

The present invention is also directed to a method for reducing internal stresses imparted to the product during pressing because of the card-decking effect of the strands.

In one embodiment of this aspect of the invention, a mat of generally parallel strands is transported through a compressing zone of a continuous belt press defined by a downwardly directed upper belt and an upwardly directed lower belt, and an asymmetrical convergence of said walls is employed so that the centerline of the mat is caused to follow a downward path as the mat moves through the compressing zone, thereby including an internal stress in the cured product in a direction opposite to the internal stress in the cured product due to card-decking.

DETAILED DESCRIPTION OF THE INVENTION

Figure 1:
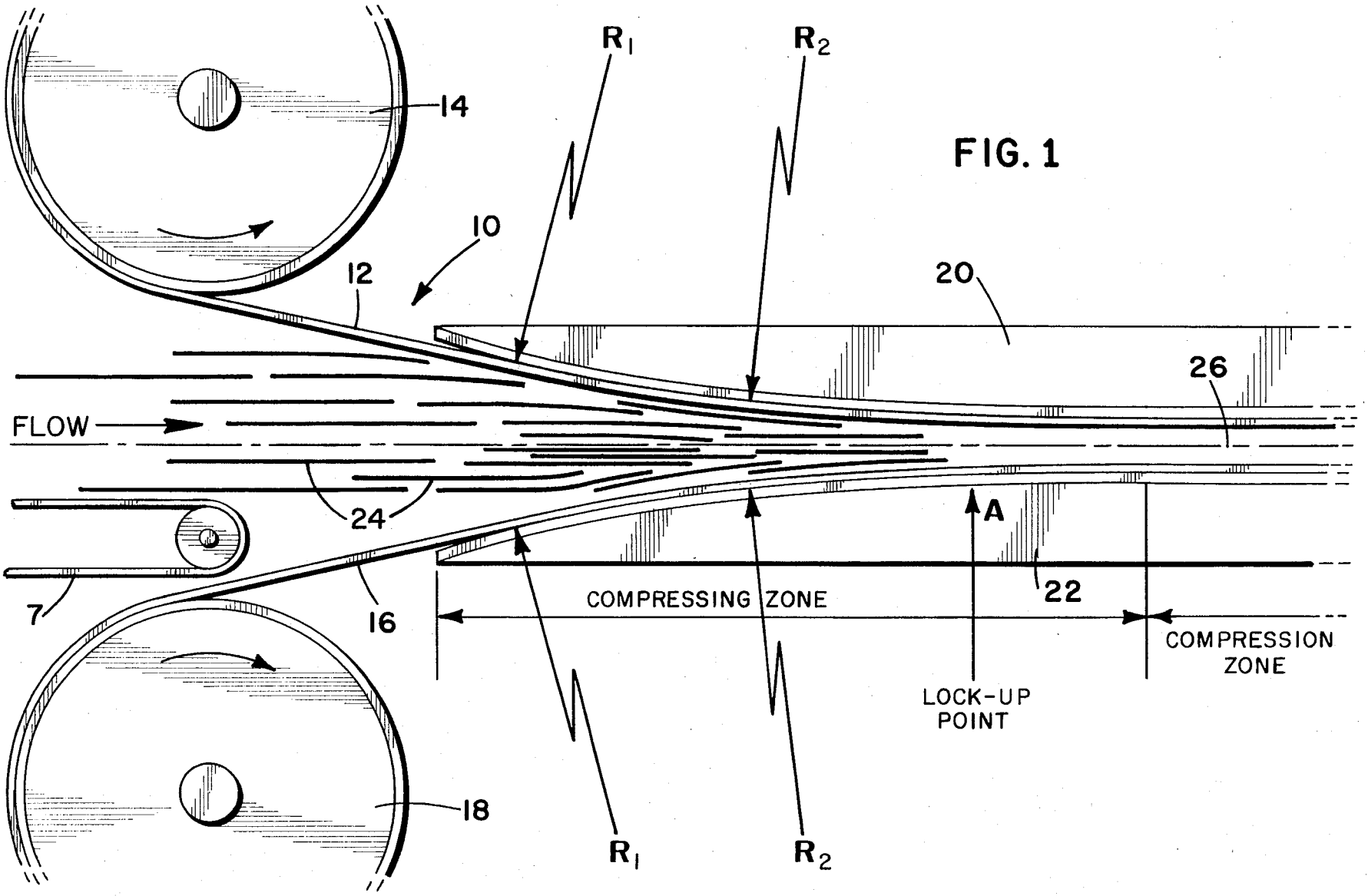
FIG. 1 is a diagrammatic side view of a first embodiment of a belt press in accordance with the present invention.

Referring to the drawings, there is shown in FIG. 1 a belt press in accordance with the present invention designated generally as 10. Belt press 10 is shown diagrammatically because the press is of conventional construction, except for the arrangement of belts and platens, which are arranged in a manner to reduce internal stresses in the products manufactured by the press. Conventional belt presses are illustrated in the aforementioned patents.

Belt press 10 includes an upper continuous press belt 12 trained about a pair of rotary drums, one of which 14 is shown in FIG. 1, and a lower continuous press belt 16 trained about a pair of rotary drums, one of which 18 is shown in FIG. 1. An upper platen 20 is located above upper press belt 12, and a lower platen 22 is placed below lower press belt 16. Platens 20 and 22 perform their conventional function of applying or keeping pressure on the material being moved between and with the belts 12 and 16. Press 10 can incorporate a heating device (not shown) to heat the material during its passage through the press. However, the platens are configured in such a manner that the end product formed by the compression of the strands by belt press 10 has reduced internal stress. Numerous conventional heating devices are used with commercially available belt presses, and co-pending application Ser. No. 406,769, filed Aug. 10, 1982, entitled "Microwave Applicator for Continuous Press" describes in detail a microwave heating device in conjunction with a continuous press.

The present invention finds particular applicability in the production of lumber products from elongated wood strands. The invention, however, is applicable to resilient strands generally. Typical strands include, without limitation, fiber glass in a resin matrix and synthetic or natural cords in an elastic matrix such as rubber. The strands have a length of at least about one foot and preferably at least about two feet. For ease of presentation, the invention will be described with respect to wood strands.

The wood strands which are preferably employed in the practice of this invention generally will have a length of at least about 1 or 2 feet and may have lengths of about 8 feet or more. The strands are desirably split or cut parallel to the grain of the wood. The strands often will have a width and thickness of from about 1/16 inch to about 1 inch, preferably about $\frac{1}{8}$ inch to about $\frac{1}{2}$ inch. It is possible and often probable that elongated members, such as strands, used for assembly of a product will vary in length from a minimum to a maximum length (e.g., from about 2 to about 8 feet). The adhesives used in a composite wood product include those known in the art and commonly used in wood products. Phenol-formaldehyde can readily be employed as can isocyanate based resins.

Mats formed from elongate strands will contain generally parallel strands in a generally random overlapping relationship. A final compressed product may have a thickness of at least about 2 inches and often at least about 4 inches. The height of the lay-up or mat will, of course, be thicker before it is compressed to provide the final product. In one case of wood strands, a mat thickness of about 12 inches provided a final product of about 4 inches; i.e., a compression ratio of about 3:1.

As seen in FIG. 1, a plurality of elongate wood strands 24 are aligned longitudinally on a conveyor and are fed between belts 12 and 16 from conveyor 7. As the wood strands 24 enter the area between platens 20 and 22, they are assembled in a random mass with generally parallel alignment. Central reference plane 26 extends medially between platens 20 and 22 and is parallel to the parallel downstream section of the platens 20 and 22. The area between the beginning of the platens 20 and 22 and the point where platens 20 and 22 begin their parallel runs is a compressing zone. Within the compressing zone, the distance between the platens 20 and 22 is decreasing. The portion of the press in which the platens 20 and 22 run parallel to each other is referred to herein as the compression zone.

Through a portion of the compressing zone, the wood strands 24 are permitted to move longitudinally relative to one another. At some point in the compressing zone, however, a state of compression is reached where strands 24 no longer can move relative to one another. This is referred to as a lock-up point. At the lock-up point, strands 24 near the belts will tend to develop a certain bowed configuration. As seen in FIG. 1, wood strands 24 take on a somewhat bowed configuration on either side of reference plane 26 as they proceed through the compressing zone. As further compressing continues, this bowed configuration is pressed out of the wood strands so that they take on a linear configuration of the end product in the compression zone.

Figure 4:
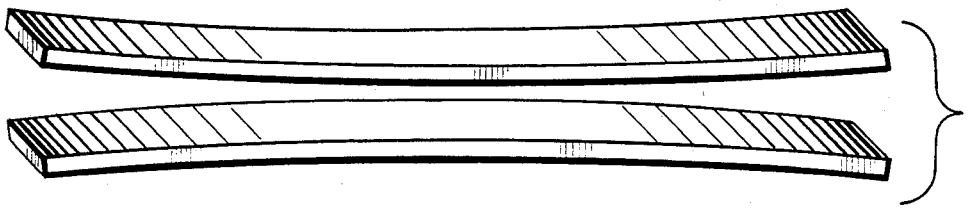
FIG. 4 illustrates an elongated lumber product, split horizontally, which was produced by prior art techniques wherein internal stresses were not relieved.

It has been discovered that the bowed configuration at lock-up results in a remembered internal stress. This internal stress is oppositely directed on either side of a reference plane 26 in a press of the type shown in FIG. 1. If the end product is split horizontally, internal forces on either side of the reference plane 26 no longer balance each other and the remembered internal stress results in a bending or bowing of the split halves of the end product as shown, for example, in FIG. 4.

The point of lock-up for any given press will be a function of the original mat thickness, the final thickness of the product, the density of the final product and the strand properties including the coefficient of friction of the strand material. For $\frac{1}{8}$ inch$\times\frac{1}{2}$ inch$\times$8 feet wood strands compressed from a 12-inch thick mat to a 4-inch thick final product, lock-up occurred at a mat thickness of about 5 to about 9 inches. The point of lock-up can be generally located by stopping operation of a continuous press and pulling out strands from the inlet until the strands that are locked between the press belts are identified.

Belts 12, 16 and platens 20, 22 have been designed to reduce the internal stress to an acceptable point. This is accomplished by having the compression take place gradually within the compressing zone so that sliding between the wood strands 24 is permitted over a substantial portion of the compressing zone and lock-up does not occur until the bow of strands 24 is small and the resultant internal stress is also small. An acceptable mode of compressing strands to alleviate bowing can be related to the radius of curvature at the point of lock-up.

Generally, the radius of curvature at the point of lock-up should be at least 30 feet and preferably at least about 50 feet. A press may employ a belt made up of a series of plates joined by hinges. Alternatively, a press may employ a platen having a series of flat areas which approximate a curved surface. Such arrangement is shown schematically in FIG. 2. In either of the latter cases the effective radius of curvature at the point of lock-up readily can be calculated.

In still another alternative, the one belt of a press may be moving in a horizontal direction at the time that the other belt begins to converge with it. It will be understood that the effective radius of the first (horizontal) belt at point of lock-up is, in such case, infinity. Accordingly, such configuration is within the contemplation of this invention. Either the upper or lower belt may be horizontal.

The choice of radius of curvature can be made to provide a cured composite product that exhibits a residual bow (when cut down the center) of no more than about one inch per 20 feet of length. Even smaller bows, for example, not more than about $\frac{1}{2}$ inch or not more than about $\frac{1}{4}$ inch per 20 feet of length can be obtained. This is true even though the composite product contains some card-decking of strands as discussed later.

The amount of residual bow for any given radius within the contemplation of this invention will depend to some degree upon the surface characteristics of the strand. For example, if strands are coated with an adhesive and wax mixture they will tend to slide more readily during the early stages of compression and the tendency to bow will be somewhat less. For that reason, strands having a lubricating additive are expressly contemplated as one preferred embodiment of this invention. Lubricating additives are well known in the art and include, inter alia, mineral and vegetable waxes, oils, soaps and the like.

The process conditions to which the composite product is subjected during its passage through the press can also have an effect on residual bow. If the composite is heated to cure the resin, the heating may have a tendency to cause some stress relieving within the composite product with a reduction in residual bow. In any event, such subsequent processing will not eliminate the residual bow.

A processing method in accordance with the present invention, utilizing the belt press 10 of FIG. 1 operates as follows. Wood strands 24 having a thickness of about $\frac{1}{8}$ inch, a width of about $\frac{1}{2}$ inch and a length of about 3 feet to 8 feet are coated with an adhesive and thereafter subjected to both heat and pressure within belt press 10 (press assembly). A mat or lay-up is formed containing wood strands 24 generally in a parallel, generally random overlapping relationship and is passed through the compressing zone defined by facing belts 12, 16 and platens 20, 22. Pressure is increased on the wood strands as they pass from the inlet end to the outlet end of the compressing zone by gradually converging the platens and belts from a point where the platens are furthest apart adjacent the inlet end of the compressing zone to a point where the platens are closest together at the outlet end of the compressing zone, with the platens extending parallel to one another into a compression zone. In FIG. 1 at the mouth of the press, the platens have an effective curvature $R_1$ which serves merely to guide the composite lay-up into the press. The lock-up occurs downstream where the radius of curvature is $R_2$. It is this radius that is important for the practice of this invention. More particularly, the platens converge at $R_1$ and the wood strands move longitudinally relative to one another through at least a portion of the compressing zone. The wood strands lock up at a point A in the compressing zone where the radius of the curvature $R_2$ in the longitudinal direction on either side or reference plane 26 of the wood strands being compressed is at least about 30 feet, a large enough radius to result in a low remembered internal stress.

Figure 2:
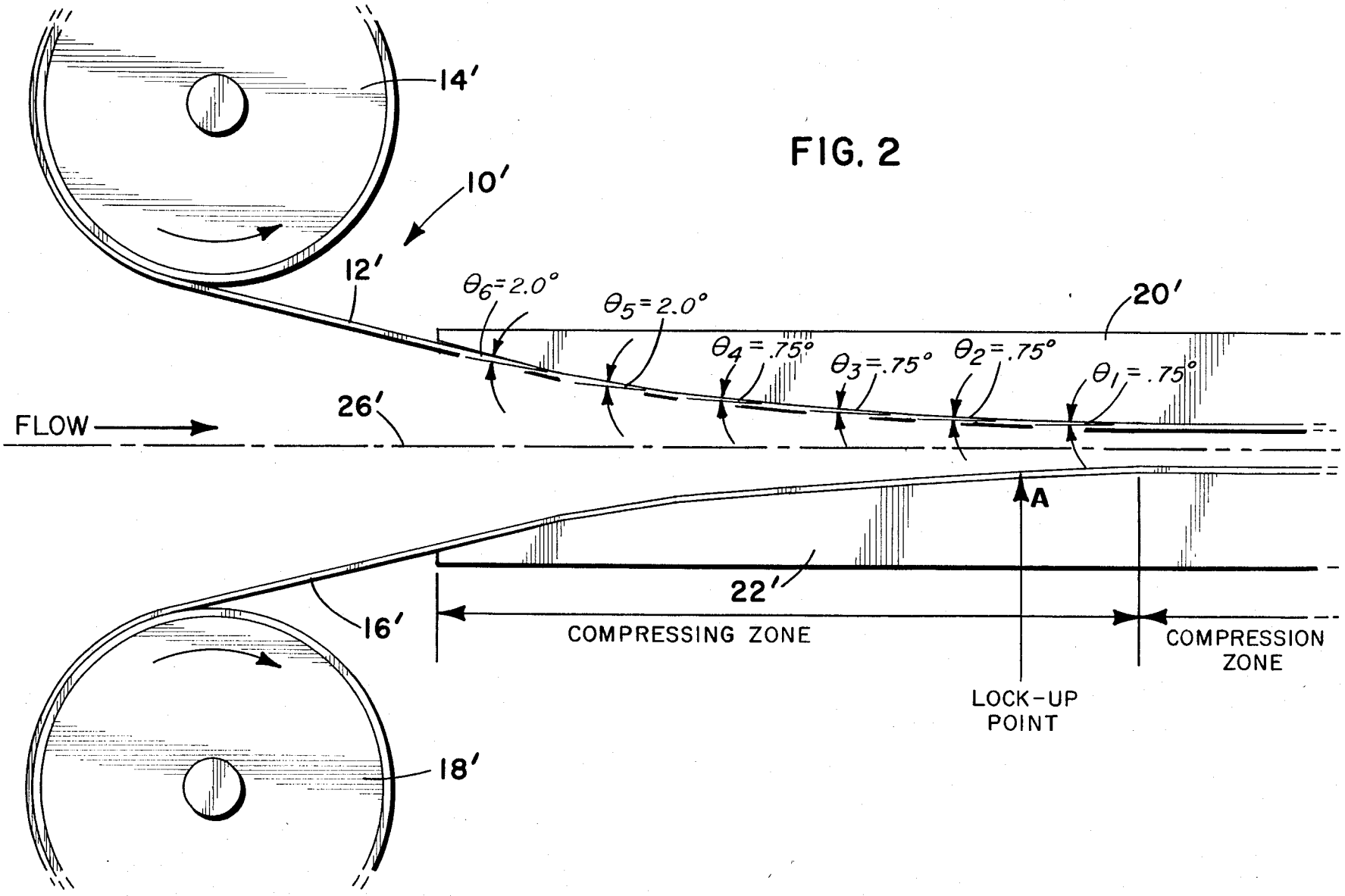
FIG. 2 is a diagrammatic side view of a second embodiment of a belt press in accordance with the present invention.

FIG. 2 illustrates a second embodiment of a press in accordance with the present invention. Elements of press 10' which are similar to elements of press 10 will be indicated by like primed numerals.

In press 10' the contact surface between platens 20', 22' with belts 12', 16', respectively, is linear rather than curved. The contact surface of platens 20', 22' is segmented into six quadrants, each about 18 inches long, and of varying slope. Each of angles theta 1–4 is 0.75° whereas angles theta 5 and 6 are 2° each. Thus, while in the first embodiment, the gradually decreasing slope or convergence of the compression zone was a radius of a curve, press 10' accomplishes the prevention of lock-up width resultant decrease in internal stress by gradually decreasing the slope of the platens from the inlet into the outlet end. The configuration of the platen of FIG. 2, however, readily can be expressed in terms of an effective radius by the intersection of lines normal from the center of adjacent plates. For the configuration shown, the effective radius is about 115 feet.

While platens 20', 22' are illustrated as segmented into only six quadrants, it should be evident that the converging section of the platens can be divided into more segments and that the segments can have varying slopes.

Embodiments of the invention in which bowing due to card-decking of strands is reduced will now be discussed.

Card-decking occurs when a mat containing elongate generally parallel strands is continuously formed, for example, on a moving conveyor belt, as discussed in co-pending Application Ser. No. 547,578 entitled "Oriented Strand Lay-Up" and filed concurrently herewith, the angle of card-decking can be minimized by forming the mat over an extended length of the conveyor. As described, an average card-decking angle of not more than about 2° in the final product can be obtained if the mat is formed over a distance that is at least 30 times the final thickness of the product. While a card-decking angle of not more than about 2° is preferred, this invention is also applicable to lay-ups which result in a card-decking angle in the final product of more than 2°.

Figure 3:
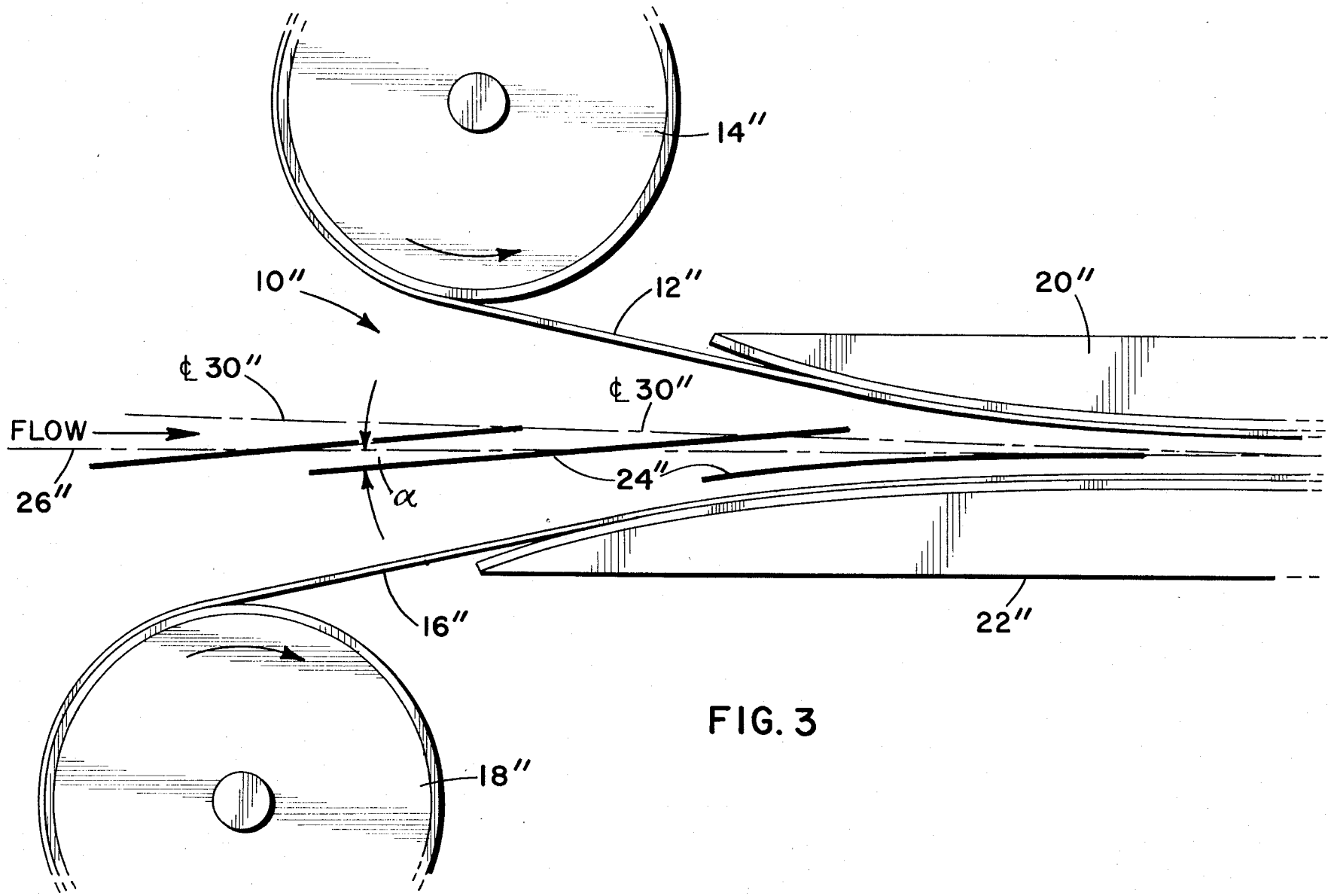
FIG. 3 is a diagrammatic side view of a belt press in accordance with the present invention which alleviates internal stress caused by the card-decking effect.

FIG. 3 illustrates a belt press 10″. Elements of press 10″ which are similar to elements of press 10 are indicated by like double primed numerals.

Figure 5:
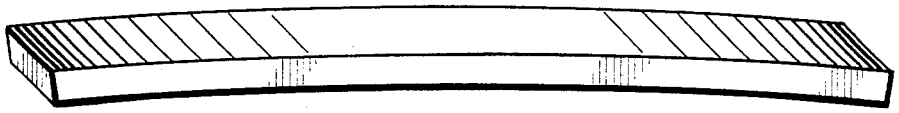
FIG. 5 illustrates an elongate wood product produced of wood strands wherein internal stresses produced by the card-decking effect were not relieved.

FIG. 3 illustrates the manner in which strands 24″ stack upon one another. When the strands 24″ are deposited on a continuously moving conveyor, succeeding strands generally overlap a portion, but not all, of preceding strands 24″. The strands thus do not lie flat, but rather build up at an angle alpha as illustrated in FIG. 3. This is similar to the angulation of cards which are spread out from a stacked deck onto a planar surface, hence, the term "card-decking." This angulation of wood strands 24″ results in an end product having an internal stress in one direction. When the strands 24″ are stacked as shown in FIG. 3, the resultant end product produced in a conventional press would result in a wood product bowed slightly downward at its end as shown in FIG. 5. This form of internal stress is in a singular direction, rather than in two directions as a result of lock-up occuring at a point of high curvature within the compressing zone. Since the stress due to card-decking is separate from the stress due to lock-up, these stresses can be considered as separate factors in the design of a product or press and can both occur in the same product.

FIG. 3 also illustrates an apparatus and method for reducing the internal stress caused by the card-decking. As seen therein, upper platen 20″ is offset downstream of the lower platen 22″. The effect of off-setting the platens is to introduce an asymmetry which can be seen with respect to the centerline 30″ in FIG. 3. As noted above, it has been determined that card-decking introduces an internal stress in the cured product that causes the product to tend to bow. By off-setting the platens, the centerline 30″ (and therefore the net average path of the strands) is caused to bend in a direction opposite the bowing tendency caused by the card-decking. As the product is cured, stress caused by the bending illustrated by centerline 30″ (the compressing geometry) is set into the product. Accordingly, the cured product has an induced stress that tends to offset the stress induced by card-decking.

While the press shown in FIG. 3 includes converging upper and lower platens, the press can have a platen (upper and lower) that is horizontal in the compressing zone. In such configuration, the center line 30″ of the composite lay-up will also be deflected in the appropriate manner. Another method of introducing asymmetry is to employ a smaller radius for one wall than the radius of the other wall. Still other methods of introducing asymmetry may also be employed.

The amount of offset for converging press walls having substantially the same radius of curvature will, of course, vary somewhat depending upon the specific product being manufactured. Generally, however, the offset will be at least about 1 foot. Often the offset will be in the range of from about 1 foot to about 10 feet. Presses with larger radii generally require a larger offset than presses with small radii. A press that has a horizontal platen in the entire compressing zone has, in effect, an infinite offset.

It will be appreciated that, although the above embodiments relating to card-decking desirably use presses having a radius of curvature of at least about 30 feet at the point of lock-up, they may also use presses having smaller radii of curvature at the point of lock-up. For example, if the cured composite is not cut in a plane parallel to the plane of the compression zone, these embodiments of the invention (e.g., offset, asymmetrical radii) can provide a finished product that is essentially free of bowing, even though the radius of curvature at the point of lock-up is small. It will be appreciated, however, that a radius of at least about 30 feet will induce less internal stress and cause less bending of the strands in the compressing zone resulting, inter alia, in less strand damage and, therefore, is preferred.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

I claim:

1. In a continuous process of forming an extended elongate product from a plurality of elongate strands by subjecting the strands to heat and pressure wherein the improvement comprises a method of compressing the strands in a manner to reduce internal stresses imparted to the product during compressing, including the steps of:

(a) transporting a mat containing generally parallel strands in a generally random overlapping relationship through a compressing zone of a press assembly; and (b) increasing the pressure on the strands as they pass from an inlet end to an outlet end of the compressing zone by gradually converging facing walls of the press assembly so that:

(i) the strands being compressed move relative to one another through at least a portion of the compressing zone, and (ii) the strands being compressed lock-up so that they no longer move relative to one another but rather only compress relative to one another at a point in the compressing zone where the radius of curvature in the longitudinal direction on either side of a central reference plane of the mat being compressed is at least about 30 feet to provide a low remembered internal stress.

2. The process of claim 1 wherein the elongate strands are elongate wood strands.

3. The process of claim 1 wherein said radius of curvature is at least about 50 feet.

4. The process of claim 2 wherein said radius of curvature is at least about 50 feet.

5. The process of claim 1 wherein both the upper and lower press walls are curved within the compressing zone.

6. The process of claim 1 wherein one press wall is horizontal throughout the compressing zone.

7. The process of claim 1 wherein said mat contains wood strands having a width and thickness of from about 1/16 to 1 inch and a length greater than about 3 feet.

8. The process of claim 1 wherein the strands have a lubricating additive.

9. In a continuous process of forming an elongate product from a plurality of elongate strands by subjecting the strands to heat and pressure wherein the improvement comprises a method for compressing the wood strands in a manner so that internal stress imparted to product during compressing because of the angle at which the strands stack is reduced, including the steps of:

(a) forming a mat containing a plurality of strands in a generally parallel, longitudinally aligned relationship and in a generally random overlapping relationship wherein succeeding strands generally overlap only a portion of preceding strands so that the strands are, on the average, angled above the horizontal;

(b) transporting the mat through a compressing zone defined between converging facing walls of a press assembly; and (c) employing an asymmetrical convergence of said upper wall and said lower wall so that the center line of said mat is caused to follow a curving path as the mat moves through the compressing zone, thereby inducing internal stress in the cured product in a direction opposite to the internal stress in the cured product due to the angle of the strands in the mat.

10. The process of claim 9 in which the elongate strands are wood strands.

11. The process of claim 9 wherein the radius of convergence of said upper and lower walls is substantially the same and wherein said convergence of said upper wall is offset from said convergence of said lower wall.

12. The process of claim 9 wherein the radius of convergence of one said wall is smaller than the radius of convergence of said other wall.

13. The process of claim 9 wherein one said wall is horizontal throughout the compressing zone.

14. The process of claim 9 wherein the strands have a lubricating additive.

* * * * *